US009358657B1

(12) United States Patent
Lu

(10) Patent No.: US 9,358,657 B1
(45) Date of Patent: Jun. 7, 2016

(54) RECESS FORMING TOOL FOR PREPARING FIBER OPTIC FERRULE ENDFACES

(75) Inventor: Yu Lu, Eden Prairie, MN (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 1383 days.

(21) Appl. No.: 13/087,868

(22) Filed: Apr. 15, 2011

Related U.S. Application Data

(60) Provisional application No. 61/325,140, filed on Apr. 16, 2010.

(51) Int. Cl.
*B24B 19/22* (2006.01)
*B24B 41/06* (2012.01)

(52) U.S. Cl.
CPC ..... *B24B 19/226* (2013.01); *B24B 41/06* (2013.01)

(58) Field of Classification Search
CPC ..... B24B 19/226; B24B 41/06; G02B 6/25
USPC ..... 451/378, 386, 391, 164, 393, 365; 408/108
See application file for complete search history.

(56) References Cited

U.S. PATENT DOCUMENTS

| | | | | | |
|---|---|---|---|---|---|
| 426,716 | A | * | 4/1890 | Drake | 144/28.1 |
| 547,151 | A | * | 10/1895 | Moseley | 144/28.9 |
| 1,610,206 | A | * | 12/1926 | Gabriel et al. | 451/320 |
| 2,725,687 | A | * | 12/1955 | Irvine | 451/164 |
| 2,783,665 | A | * | 3/1957 | Saunders | 408/108 |
| 2,882,574 | A | * | 4/1959 | Shumate | 24/132 R |
| 3,339,313 | A | * | 9/1967 | Lindhag | 451/164 |
| 3,807,889 | A | * | 4/1974 | Kiezel | 408/108 |
| 3,826,483 | A | * | 7/1974 | Siegel | 269/203 |
| 4,178,722 | A | * | 12/1979 | Forman et al. | 451/359 |
| 4,923,340 | A | * | 5/1990 | Hegedusch | 408/72 R |
| 4,991,437 | A | * | 2/1991 | Hanchett | 73/455 |
| 5,056,966 | A | * | 10/1991 | Lee | 408/115 R |
| 5,214,730 | A | | 5/1993 | Nagasawa et al. | |
| 5,218,786 | A | * | 6/1993 | Takahashi | 451/177 |
| 5,447,464 | A | * | 9/1995 | Franklin et al. | 451/28 |
| 5,542,725 | A | * | 8/1996 | Ballew | 292/339 |
| 5,577,149 | A | * | 11/1996 | Averbeck et al. | 385/134 |
| 5,683,290 | A | * | 11/1997 | Kanda et al. | 451/72 |
| 5,727,989 | A | * | 3/1998 | Ohno et al. | 451/41 |
| 5,813,902 | A | * | 9/1998 | Wiegand | 451/65 |
| 5,823,859 | A | * | 10/1998 | Erdogan et al. | 451/65 |
| 6,099,392 | A | * | 8/2000 | Wiegand et al. | 451/41 |

(Continued)

FOREIGN PATENT DOCUMENTS

| | | | |
|---|---|---|---|
| DE | 102006046774 | * | 4/2008 |
| JP | 59214553 A | * | 12/1984 |

(Continued)

*Primary Examiner* — Lee D Wilson
*Assistant Examiner* — Joel Crandall
(74) *Attorney, Agent, or Firm* — Merchant & Gould P.C.

(57) ABSTRACT

A tool and a method for forming a pair of recesses on an endface of a fiber optic ferrule are disclosed. The tool includes a base, a ferrule holder slidingly mounted to the base along a guided path, and a pair of material removing members extending in a direction parallel to the guided path. The material removing members are spaced a distance perpendicular to the guided path from each other and mounted to the base. The tool includes a linkage that clamps and centers the ferrule about the tool. The recesses can adjoin pin holes of the ferrule. The linkage can be a parallelogram linkage.

30 Claims, 12 Drawing Sheets

(56) References Cited

U.S. PATENT DOCUMENTS

| | | | | |
|---|---|---|---|---|
| 6,179,698 | B1 * | 1/2001 | Lam | 451/364 |
| 6,579,014 | B2 | 6/2003 | Melton et al. | |
| 6,582,286 | B2 * | 6/2003 | Minami et al. | 451/270 |
| 6,648,520 | B2 | 11/2003 | McDonald et al. | |
| 6,878,040 | B2 * | 4/2005 | Wang | 451/11 |
| 6,899,467 | B2 | 5/2005 | McDonald et al. | |
| 7,094,008 | B2 * | 8/2006 | Hartsfield, Jr. | 408/103 |
| 7,169,026 | B2 * | 1/2007 | Minami et al. | 451/278 |
| 7,407,431 | B2 * | 8/2008 | Lee et al. | 451/5 |
| 7,686,267 | B2 * | 3/2010 | DaSilva | 248/229.12 |
| 8,187,059 | B2 * | 5/2012 | Bareel et al. | 451/356 |
| 8,292,699 | B2 * | 10/2012 | Bylander et al. | 451/344 |
| 2010/0154987 | A1 * | 6/2010 | Vontell, Sr. | 156/273.7 |

FOREIGN PATENT DOCUMENTS

| | | | | |
|---|---|---|---|---|
| JP | 60080549 | A | * | 5/1985 |
| JP | 63283854 | A | * | 11/1988 |
| JP | 02218546 | A | * | 8/1990 |
| WO | WO 2004069474 | A1 | * | 8/2004 |

* cited by examiner

RECESS FORMING TOOL FOR PREPARING FIBER OPTIC FERRULE ENDFACES

CROSS-REFERENCE TO RELATED APPLICATION

This application claims the benefit of U.S. Provisional Patent Application Ser. No. 61/325,140, filed Apr. 16, 2010, which application is hereby incorporated by reference in its entirety.

TECHNICAL FIELD

The present disclosure relates to fiber optic cable assemblies, and more particularly to manufacturing connectorized fiber optic cable assemblies.

BACKGROUND

Fiber optic cables are widely used to transmit light signals for high speed data transmission. A fiber optic cable typically includes: (1) an optical fiber or optical fibers; (2) a buffer or buffers that surrounds the fiber or fibers; (3) a strength layer that surrounds the buffer or buffers; and (4) an outer jacket. Optical fibers function to carry optical signals. A typical optical fiber includes an inner core surrounded by a cladding that is covered by a coating. Buffers (e.g., loose or tight buffer tubes) typically function to surround and protect coated optical fibers. Strength layers add mechanical strength to fiber optic cables to protect the internal optical fibers against stresses applied to the cables during installation and thereafter. Example strength layers include aramid yarn, steel and epoxy reinforced glass roving. Outer jackets provide protection against damage caused by crushing, abrasions, and other physical damage. Outer jackets also provide protection against chemical damage (e.g., ozone, alkali, acids).

Fiber optic cable connection systems are used to facilitate connecting and disconnecting fiber optic cables in the field without requiring a splice. A typical fiber optic cable connection system for interconnecting two fiber optic cables includes fiber optic connectors mounted at ends of the fiber optic cables. Fiber optic connectors generally include ferrules that support ends of the optical fibers of the fiber optic cables. Endfaces of the ferrules are typically polished and are often angled. For certain applications, fiber optic adapters can be used to align and/or mechanically couple two fiber optic connectors together. Fiber optic connectors can include ferrules supporting single optical fibers (i.e., single-fiber ferrules corresponding to single-fiber connectors) and can also include ferrules supporting multiple optical fibers (i.e., multiple-fiber ferrules corresponding to multiple-fiber connectors). One example of an existing single-fiber fiber optic connection system is described at U.S. Pat. Nos. 6,579,014; 6,648,520; and 6,899,467. An example of a multi-fiber connection system is disclosed at U.S. Pat. No. 5,214,730.

SUMMARY

The present disclosure relates to a tool for removing material from an endface of a fiber optic ferrule. The tool can be used for preparing, finishing, and/or refinishing the endface. By removing the material from the endface, the endface can be polished and/or one or more recesses can be formed on the endface of the fiber optic ferrule. In one embodiment, the tool can include a guide that guides movement of a ferrule along an abrading structure thereby causing the abrading structure to remove and/or burnish material from a desired location on the ferrule end face. In one embodiment, the abrading structure includes an abrading region that corresponds to the location on the ferrule end face where material is desired to be removed, and a non-abrading region that corresponds to a location on the ferrule end face where material is not desired to be removed. In one embodiment, the non-abrading region is recessed relative to the abrading region. In another embodiment, the non-abrading region is positioned between first and second abrading regions.

In a one embodiment, the tool includes a fiber optic ferrule holder, a parallelogram linkage, and a base. The fiber optic ferrule holder includes a pair of jaws adapted to clamp the fiber optic ferrule. The parallelogram linkage includes a pair of pivoting links and a pair of guiding links. Each pivoting link of the pair of the pivoting links is positioned opposite from each other, and each guiding link of the pair of the guiding links is positioned opposite from each other about the parallelogram linkage. Each of the pivoting links defines a link pivot axis. Each of the guiding links is positioned on opposite sides of the fiber optic ferrule holder. The pair of the guiding links linearly guide the fiber optic ferrule holder along a guided path, and each of the jaws of the fiber optic ferrule holder slidingly attaches to a corresponding one of the pair of the guiding links. The base defines a pair of base pivot axes and includes a media bed. Each of the pivoting links rotatably connects about the link pivot axis to the base about a corresponding one of the pair of the base pivot axes.

In certain embodiments, the tool further includes material removing media that is mounted to the media bed of the base. The material removing media extends parallel to the guided path and is adapted to remove the material from the endface of the fiber optic ferrule. The material is removed when the fiber optic ferrule is clamped between the pair of the jaws of the fiber optic ferrule holder, the endface of the fiber optic ferrule is engaged with the material removing media, and the fiber optic ferrule holder is moved along the guided path. In certain embodiments, the media bed of the base includes a recessed area that extends parallel to the guided path, and the material removing media includes a pair of media sheets that each include an edge parallel to the guided path. The media sheets are positioned opposite the recessed area of the media bed from each other, and the edge of each of the media sheets is positioned adjacent the recessed area. The recessed area can be a centered recess area, and the pair of the base pivot axes can be centered between the edges of the pair of the media sheets. Each of the link pivot axes can be centered between a pair of corresponding linkage joints between the pivoting links and the guiding links. In certain embodiments, the media sheets include polishing paper (e.g., sand paper). The centered recessed area of the media bed can be configured and the media sheets can thereby be positioned such that the material removed from the endface of the fiber optic ferrule forms a pair of recesses adjacent a corresponding pair of pin holes of the fiber optic ferrule.

In certain embodiments, the fiber optic ferrule holder is moved along the guided path manually (e.g., by hand). In certain embodiments, the base includes a pair of pivot posts that correspondingly define the pair of the base pivot axes, and the pivoting links each include a bore that defines the corresponding link pivot axis. Each of the pivot posts rotatably mounts a corresponding one of the bores and thereby aligns the corresponding link pivot and base pivot axes. The pivot posts can rotatably and translatably mount the corresponding one of the bores and thereby align the corresponding link pivot and base pivot axes. The fiber optic ferrule holder can thereby be spaced from the media bed at a variable distance, and the fiber optic ferrule holder can be adapted to fixedly hold the fiber optic ferrule. The fiber optic ferrule can thereby engage material removing media mounted to the media bed of the base by the bores of the pivoting links sliding along the pivot posts of the base. Alternatively, the pivot posts can only rotatably mount the corresponding one of the bores. The fiber optic ferrule holder can thereby be spaced from the media bed at a fixed distance, and the fiber optic ferrule holder can be adapted to slidingly hold the fiber optic ferrule. The fiber optic ferrule holder can thereby allow the fiber optic ferrule to engage the material removing media mounted to the media bed of the base.

In certain embodiments, the tool further includes a pair of linear bearings. Each of the linear bearings slidingly attaches a corresponding one of the pair of the jaws of the fiber optic ferrule holder to the corresponding guiding link. Each of the linear bearings can include rolling elements (e.g., recirculating balls or wheels).

In certain embodiments, the parallelogram linkage is spring loaded such that the guiding links are urged together and thereby urge the jaws of the fiber optic ferrule holder together. The tool can include at least one spring operably connected between the base and at least one of the guiding links. The tool can include at least one torsion spring operably connected across at least one linkage joint between the pivoting links and the guiding links. The tool can include at least one torsion spring operably connected between at least one of the pivoting links and the base. The tool can include at least one linear spring (e.g., a compression spring and/or a tension spring) operably connected between at least one of the pivoting links and the base. The compression spring and/or the tension spring can spring-load the translatably mounted pivoting links along the corresponding link pivot and/or base pivot axes. The torsion spring and the linear spring can be a combined spring providing both torsional and linear spring functions.

In certain embodiments, at least one retaining lip is included on at least one of the jaws of the fiber optic ferrule holder. The retaining lip can be adapted to orient the fiber optic ferrule. In certain embodiments, the at least one of the jaws includes a pair of the retaining lips.

In an example embodiment, the tool forms a pair of recesses on the endface of the fiber optic ferrule. Each of the recesses is adjacent one pin hole of a pair of pin holes of the fiber optic ferrule. The tool includes a base, a fiber optic ferrule holder, and a guide arrangement. The base includes a pair of opposed material removing regions. The pair of the material removing regions includes a pair of adjacent edges spaced from each other by a distance. The fiber optic ferrule holder is adapted to mount the fiber optic ferrule and thereby center the pair of the pin holes with respect to the pair of the adjacent edges of the material removing regions. The guide arrangement is adapted to guide the fiber optic ferrule holder along a plane parallel to the pair of the adjacent edges and perpendicular to the material removing regions. In certain embodiments, the guide arrangement includes the parallelogram linkage that centers the pair of the jaws of the fiber optic ferrule holder and thereby centers the pair of the pin holes with respect to the pair of the adjacent edges of the material removing regions. In certain embodiments, the base includes a recessed area adjoining and extending parallel to the pair of the adjacent edges of the material removing regions. In certain embodiments, the material removing regions of the base include polishing paper.

The present disclosure also relates to a method of forming one or more or a pair of recesses on an endface of a fiber optic ferrule. Each of the recesses of the pair of the recesses can be adjacent one pin hole of a pair of pin holes of the fiber optic ferrule. The method includes providing the fiber optic ferrule; providing the tool; mounting the fiber optic ferrule to the fiber optic ferrule holder; engaging the endface of the fiber optic ferrule with the pair of the material removing members of the tool; moving the fiber optic ferrule holder along the guided path; and dismounting the fiber optic ferrule from the fiber optic ferrule holder. The tool can include the base, the fiber optic ferrule holder that is slidingly mounted to the base along the guided path, and a pair of material removing members that extend in the direction parallel to the guided path. The material removing members can be spaced a distance perpendicular to the guided path from each other and mounted to the base. The mounting of the fiber optic ferrule to the fiber optic ferrule holder can include clamping the fiber optic ferrule between the pair of the jaws of the fiber optic ferrule holder. The tool can define a plane parallel to the guided path and perpendicular to material removing surfaces of the material removing members. The distance that the pair of the material removing members are spaced from each other can be centered about the plane, and the tool can further include a linkage adapted to center the pair of the jaws about the plane. The linkage can include the pair of the guiding links, the pair of the pivoting links, can be the parallelogram linkage, and/or can be rotatably mounted to the base about a corresponding pair of axes. The pair of the axes can be contained within the plane.

DETAILED DESCRIPTION

Figure 17:
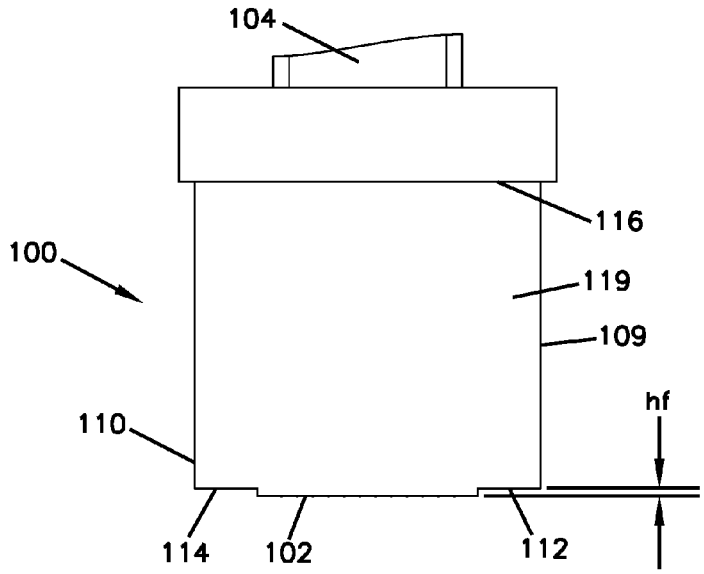
FIG. 17 is a side elevation view of the fiber optic ferrule of FIG. 1 including a pair of recesses.
Figure 18:
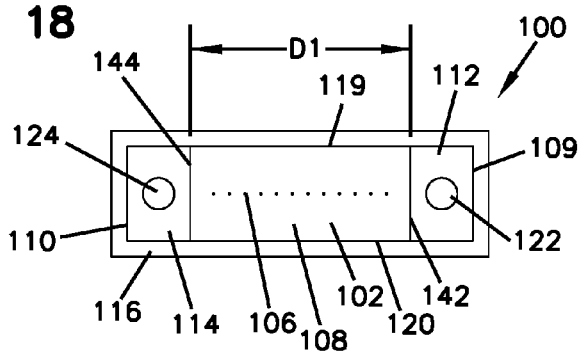
FIG. 18 is an end view of the fiber optic ferrule of FIG. 1 including the pair of the recesses of FIG. 17.
Figure 19:
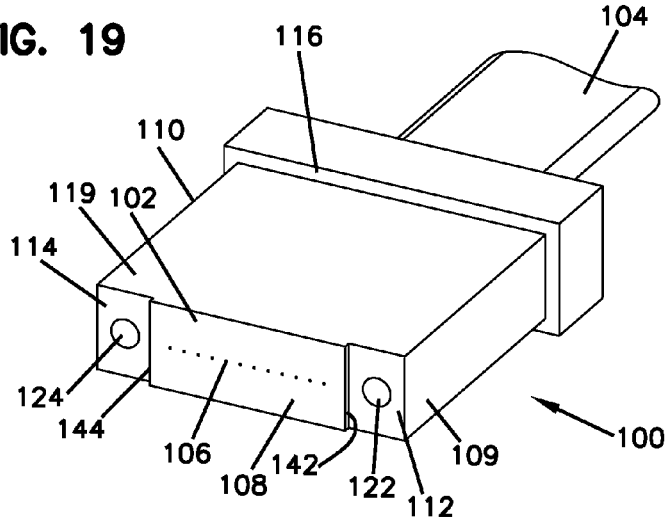
FIG. 19 is an isometric view of the fiber optic ferrule of FIG. 1 including the pair of the recesses of FIG. 17.

The present disclosure relates to a tool 10 for removing material from an endface 102 of a fiber optic ferrule 100. The example tool 10, illustrated at FIGS. 1-13, can be used for preparing, finishing, and/or refinishing the endface 102. By removing the material from the endface 102, the endface 102 can be polished and/or one or more recesses 112, 114 can be formed on the endface 102 of the fiber optic ferrule 100 (see FIGS. 17-19). A goal of the present disclosure is to provide a compact tool 10 that can be field deployed. In the example embodiment, the tool 10 is manually operated (e.g., by hand) and requires no electrical power to operate. In other embodiments, a tool incorporating inventive aspects of the present disclosure can be powered and/or automated.

The fiber optic ferrule 100, illustrated at FIGS. 14-21, is a multi-fiber fiber optic ferrule terminating a plurality of optical fibers 106 of a fiber optic cable 104. The endface 102 includes a fiber terminating region 108. In the example fiber optic ferrule 100, the fiber terminating region 108 terminates twelve of the optical fibers 106 and is centered between a first side 109 and a second side 110 of the fiber optic ferrule 100. A first pin hole 122 of the fiber optic ferrule 100 is positioned between the fiber terminating region 108 and the first side 109, and a second pin hole 124 of the fiber optic ferrule 100 is positioned between the fiber terminating region 108 and the second side 110. The first and the second pin holes 122, 124 are a pair of pin holes. As illustrated, the fiber optic ferrule 100 is a female fiber optic ferrule. A pin (not shown) can be installed in one or both of the pin holes 122, 124. A male fiber optic ferrule can be formed by installing one of the pins in each of the pin holes 122, 124. The male fiber optic ferrule can be connected to the female fiber optic ferrule 100 by inserting the pins of the male fiber optic ferrule into the corresponding pin holes 122, 124 of the female fiber optic ferrule 100.

Figure 20:
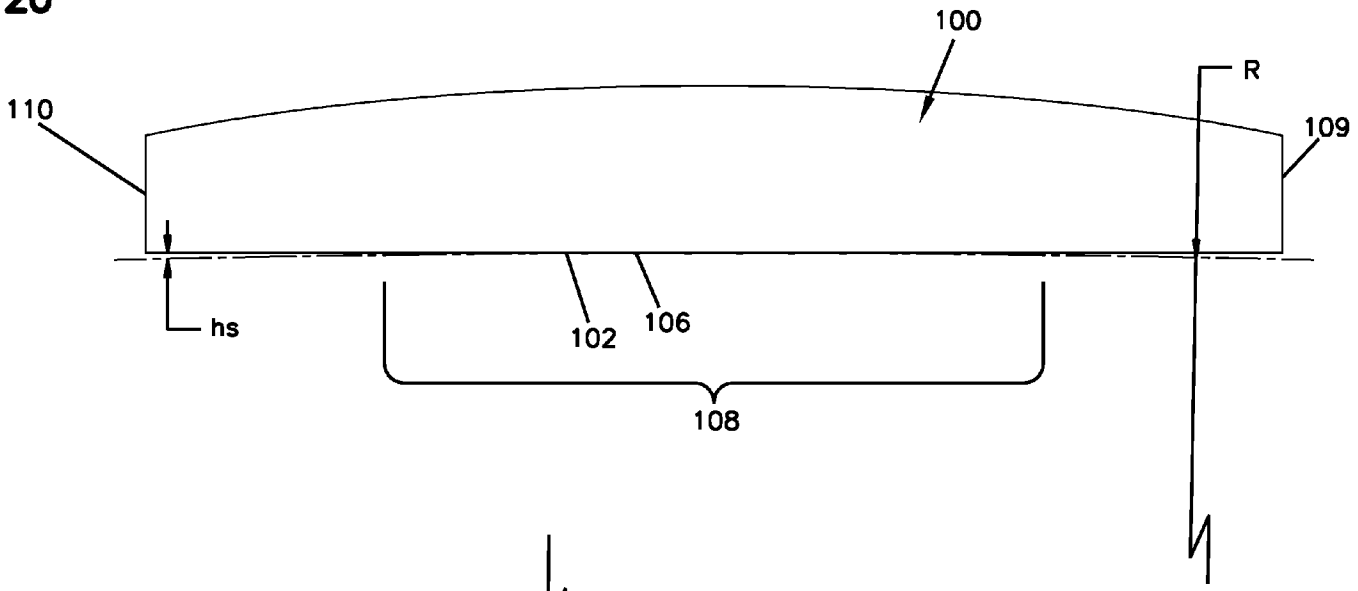
FIG. 20 is an enlarged portion of FIG. 14 illustrating a concave shape.
Figure 21:
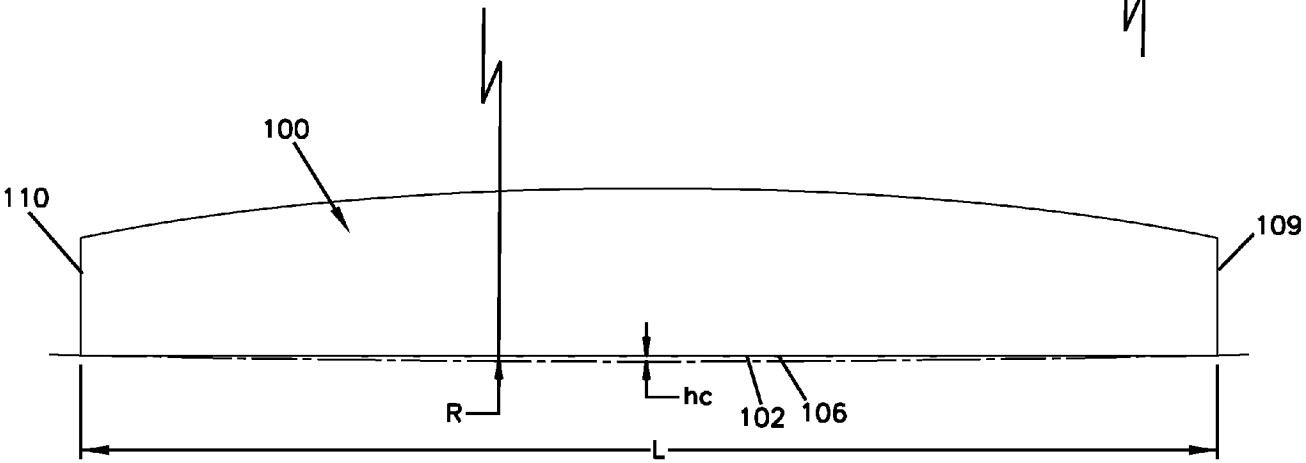
FIG. 21 is an enlarged portion of FIG. 14 illustrating a convex shape.

The fiber optic ferrule 100 has certain geometry requirements (e.g., tolerances) that are needed for a high quality optical connection to be created between the optical fibers 106 of the male fiber optic ferrule and the female fiber optic ferrule 100 when connected. Thus, the endface 102 of the fiber optic ferrule 100 can be generally flat, especially along a length L that extends between the first and the second sides 109, 110 (see FIGS. 15 and 21). For example, per certain International Electrotechnical Commission specifications, a radius on a long axis of an MT fiber optic ferrule must be larger than 1000 mm. Certain ferrules are produced with the radius around 20,000 mm which equates to an out-of-flatness dimension of 0.3 μm. FIGS. 20 and 21 illustrate a radius R swept between the first and the second sides 109, 110 of the fiber optic ferrule 100. FIG. 20 illustrates the radius R as a concave radius that would result in an out-of-flatness dimension of hs. FIG. 21 illustrates the radius R as a convex radius that would result in an out-of-flatness dimension of hc. A small piece of contamination on the endface 102, with dimensions on the order of hs and/or hc, can detrimentally affect the optical connection. Likewise, a small deformation on the endface 102, with dimensions on the order of hs and/or hc, can detrimentally affect the optical connection. The dimensions hs and hc can be on the order of 0.3 μm.

The fiber optic ferrule 100 can be made (e.g., injection molded) from a plastic material (e.g., a thermo-plastic material or a thermo-set plastic material). The plastic material can be relatively soft especially compared to the pins. Installing the pins in the pin holes 122, 124 of the fiber optic ferrule 100 can raise (i.e., upset) material of the endface 102 adjacent the pin holes 122, 124 a distance greater than the dimension hs. The installing of the pins in the pin holes 122, 124 can occur when the male fiber optic connector is made, when the male or female fiber optic connector is tested, and/or when connecting the male fiber optic connector to the female fiber optic ferrule 100. In an illustrated example embodiment, the tool 10 forms the pair of the recesses 112, 114 on the endface 102 of the fiber optic ferrule 100 to a depth with a dimension hf (see FIG. 17). The dimension hf is greater than the dimension hs. The recess 112 is adjacent the pin hole 122, and the recess 114 is adjacent the pin hole 124 of the fiber optic ferrule 100 (see FIGS. 14-19). The recesses 112, 114 can be formed prior to the pins being installed into the pin holes 122, 124. By forming the recesses 112, 114 prior to inserting the pins into the pin holes 122, 124, subsequent damage adjacent the pin holes 122, 124 can be accommodated by the recesses 112, 114 and thereby allow the fiber optic connector to function without being degraded by the subsequent damage. Damaged (e.g., upset) material can be removed by the tool 10 after the fiber optic connector has been damaged, and the fiber optic connector can thereby be repaired.

Figure 6:
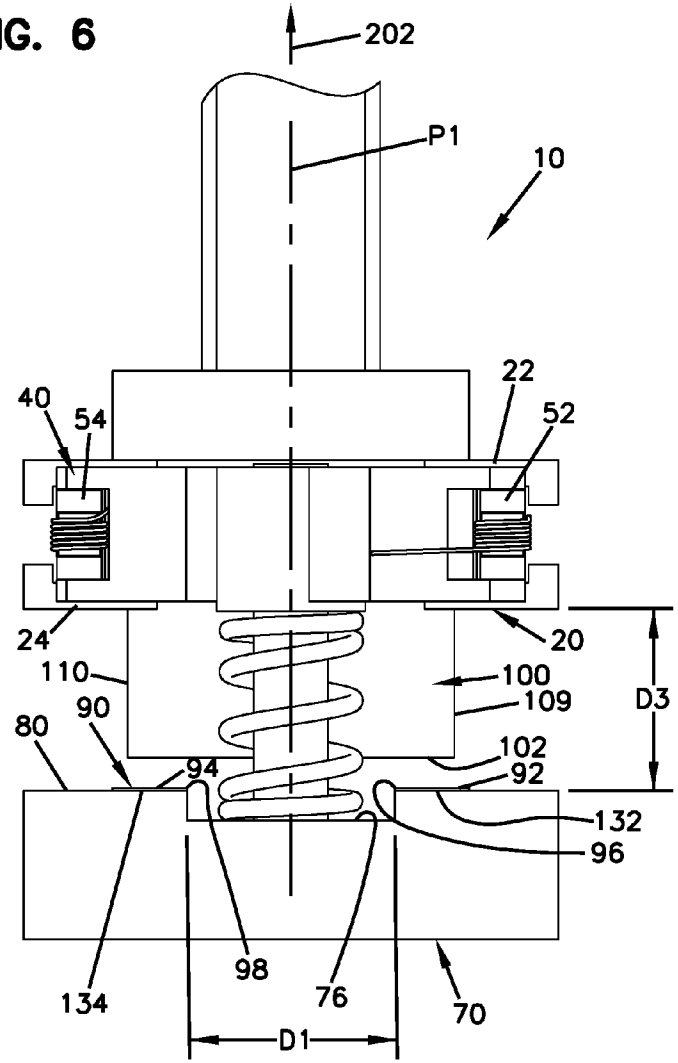
FIG. 6 is an end elevation view of the tool and the fiber optic ferrule of FIG. 1.
Figure 15:
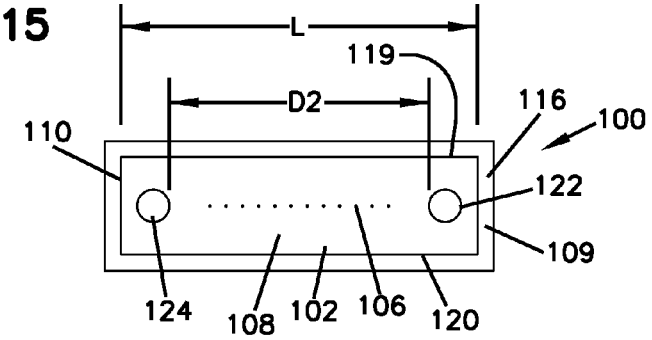
FIG. 15 is an end view of the fiber optic ferrule of FIG. 1.
Figure 16:
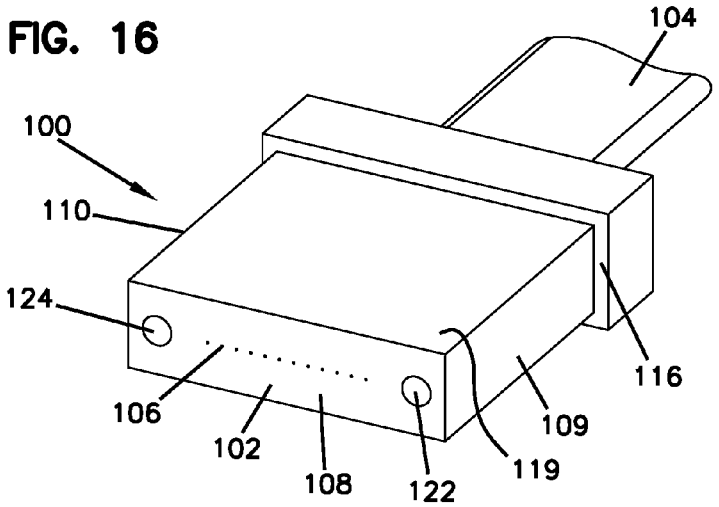
FIG. 16 is an isometric view of the fiber optic ferrule of FIG. 1.

The tool 10 includes a base 70, a fiber optic ferrule holder 20, and a guide arrangement 14 (see FIGS. 1-4). The base 70 includes a pair of opposed material removing regions 132, 134. The pair of the material removing regions 132, 134 includes a pair of adjacent edges 96, 98 spaced from each other by a distance D1 (see FIG. 6). The fiber optic ferrule holder 20 is adapted to mount the fiber optic ferrule 100 and thereby center the pair of the pin holes 122, 124 with respect to the pair of the adjacent edges 96, 98 of the material removing regions 132, 134. The pin holes 122, 124 are spaced from each other by a distance D2 as illustrated at FIG. 15. In a preferred embodiment, the distance D1 is less than the distance D2. In a preferred embodiment, the distance D1 encompasses the fiber terminating region 108 of the endface 102. The distance D1 of the pair of the adjacent edges 96, 98 of the tool 10 is transferred to edges 142, 144 of the respective recesses 112, 114 formed on the endface 102 by the tool 10 (see FIG. 18). As illustrated at FIG. 6, the material removing region 132 extends beyond the first side 109 of the fiber optic ferrule 100, and the material removing region 134 extends beyond the second side 110. Thus, the recess 112 extends to the side 109 of the fiber optic ferrule 100 from the edge 142, and the recess 114 extends to the side 110 from the edge 144 (see FIG. 17).

The recesses 112, 114 can be formed on the fiber optic ferrule 100 by the tool 10 before the pins are installed to make the male fiber optic ferrule. The recesses 112, 114 can be formed by the tool 10 before the fiber optic ferrule 100 is first connected to another fiber optic ferrule 100 or formed on a used fiber optic ferrule before it is damaged. The recesses 112, 114 can be applied by the tool 10 to repair an existing fiber optic ferrule 100 after the material adjacent the pin holes 122, 124 has been upset. The recesses 112, 114 can improve the optical connection between the male fiber optic ferrule and the female fiber optic ferrule 100.

Figure 1:
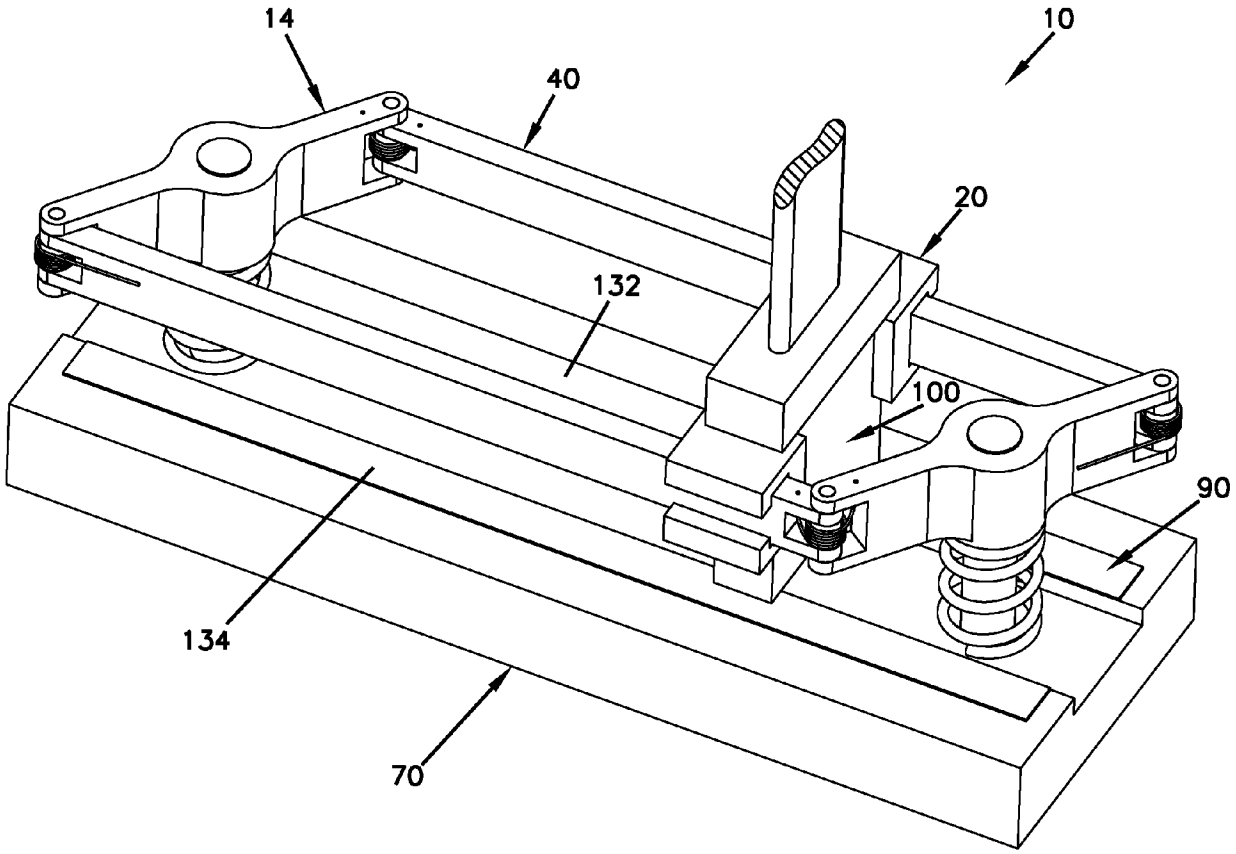
FIG. 1 is a perspective view of a tool and a fiber optic ferrule, with an endface, mounted in a ferrule holder of the tool, the tool further including a linkage and a base with material removing members.
Figure 2:
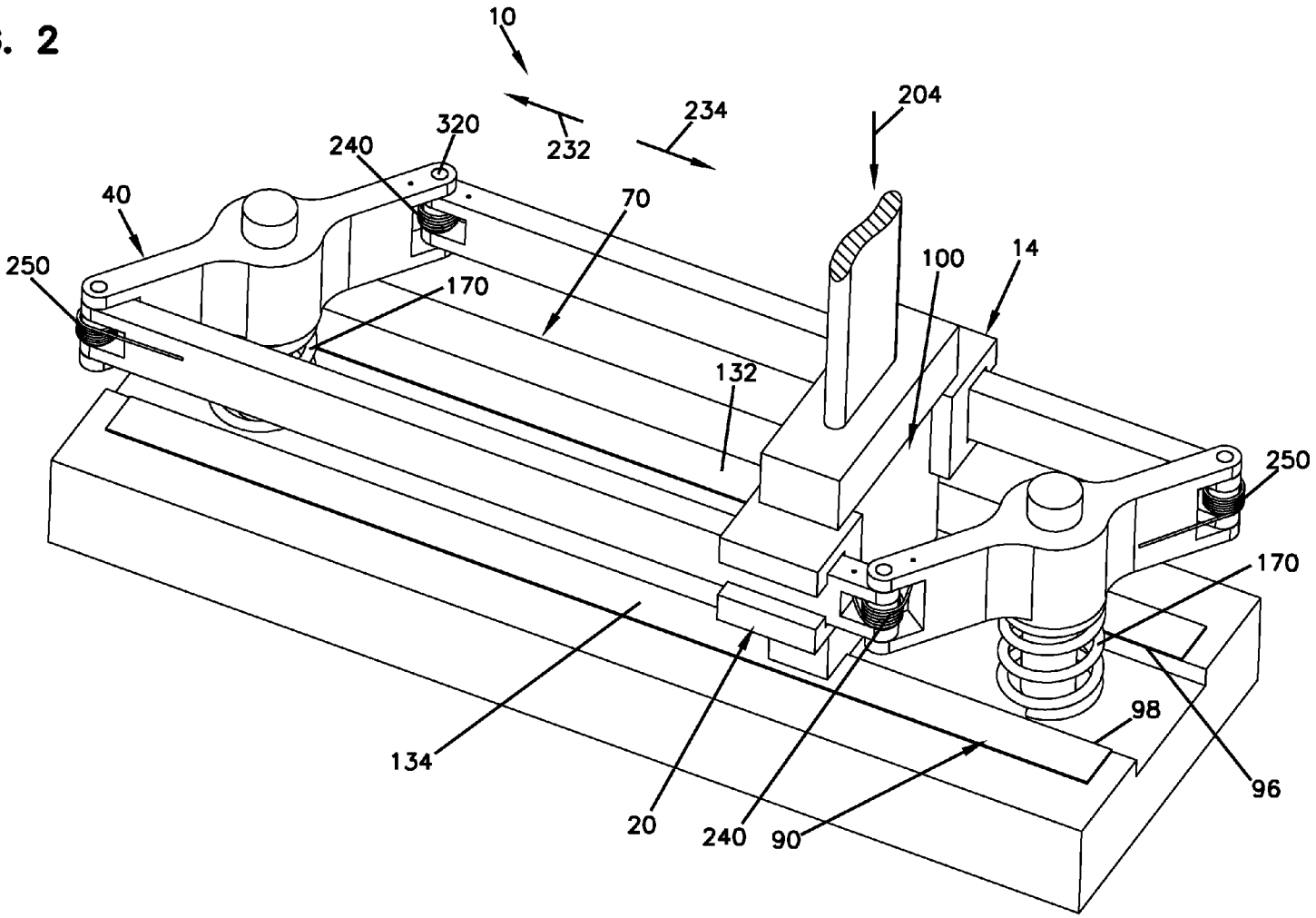
FIG. 2 is the perspective view of FIG. 1 but with the ferule holder depressed and the endface engaging the material removing members.
Figure 3:
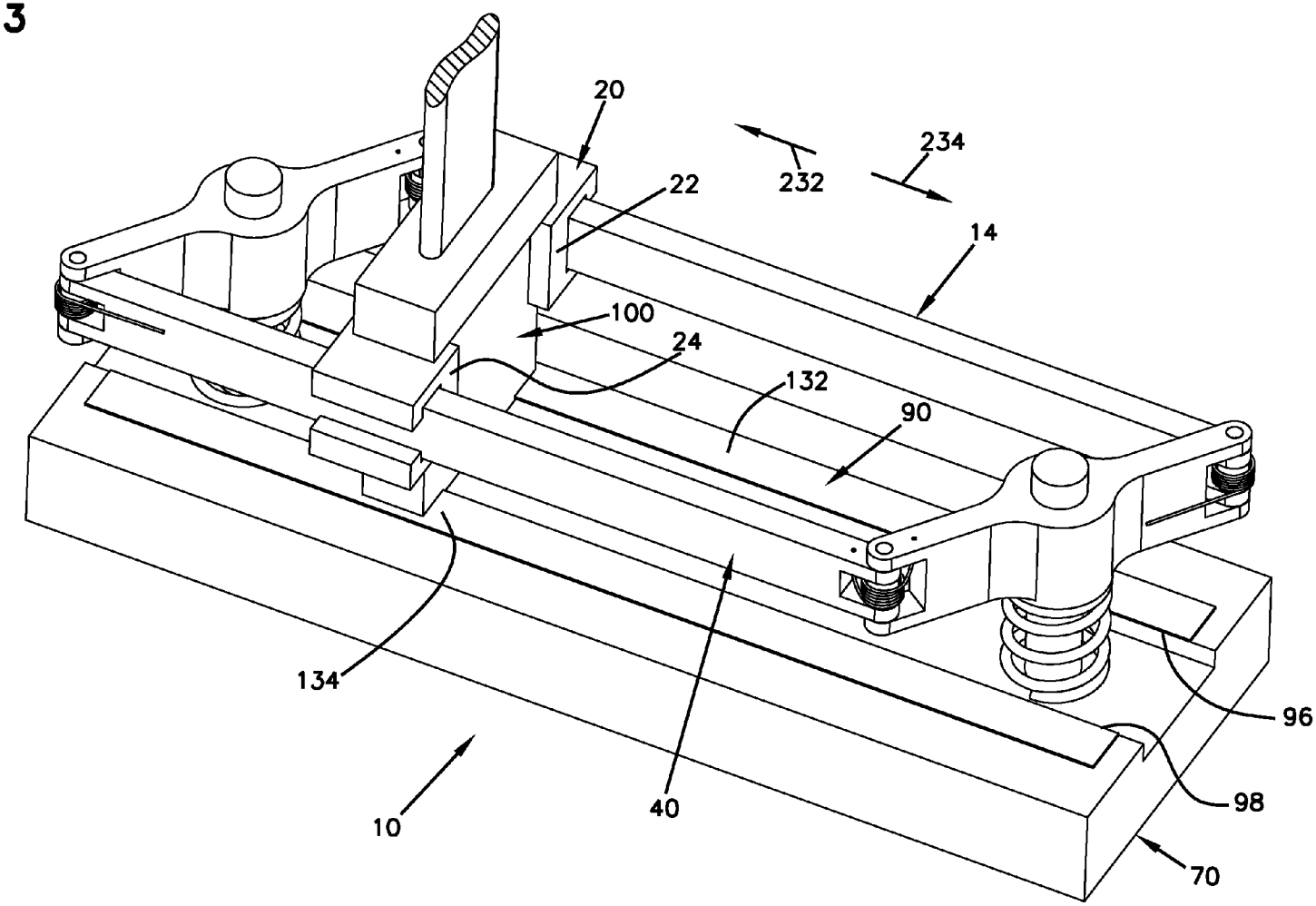
FIG. 3 is the perspective view of FIG. 2 but with the ferule holder slid along the linkage.

The guide arrangement 14 is adapted to guide the fiber optic ferrule holder 20 along a plane P1 (see FIGS. 6 and 7) parallel to the pair of the adjacent edges 96, 98 and perpendicular to the material removing regions 132, 134 of the base 70. A sliding direction 232 and an opposite sliding direction 234 are parallel to the pair of the adjacent edges 96, 98, as illustrated at FIGS. 2 and 3. The sliding directions 232, 234 are contained within the plane P1 or are parallel with the plane P1. When the endface 102 is engaged with the material removing regions 132, 134, sliding the fiber optic ferrule holder 20, and thereby the fiber optic ferrule 100, in either of the sliding directions 232, 234 will cause the removal of material from the endface 102. The fiber optic ferrule holder 20 can be alternately slid in the sliding directions 232, 234 (e.g., between positions illustrated at FIGS. 2 and 3) repeatedly until the material removed equals a desired amount of material (e.g., until the depth of the recesses 112, 114 reaches the dimension hf). An engaging direction 204 (see FIGS. 2 and 7) and an opposite disengaging direction 202 (see FIGS. 4 and 6) are perpendicular to the material removing regions 132, 134 of the base 70. The engaging and the disengaging directions 204, 202 are contained within the plane P1 or are parallel with the plane P1. By moving the fiber optic ferrule holder 20, and thereby the fiber optic ferrule 100, in the engaging direction 204, the endface 102 can be engaged with the material removing regions 132, 134 of the base 70. By moving the fiber optic ferrule holder 20, and thereby the fiber optic ferrule 100, in the disengaging direction 202, the endface 102 can be disengaged from the material removing regions 132, 134. Thus, the fiber optic ferrule holder 20 can be spaced from the material removing regions 132, 134 by a variable distance D3 (see FIGS. 6 and 7).

Figure 7:
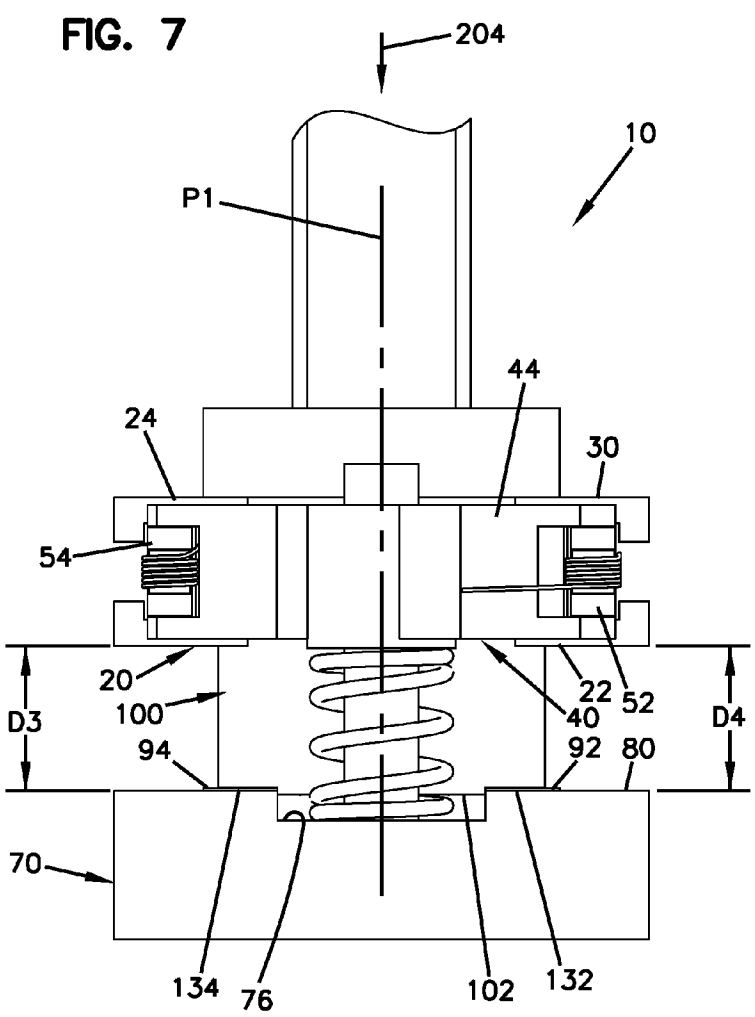
FIG. 7 is the end elevation view of FIG. 6 but with the ferule holder depressed and the endface engaging the material removing members.
Figure 11:
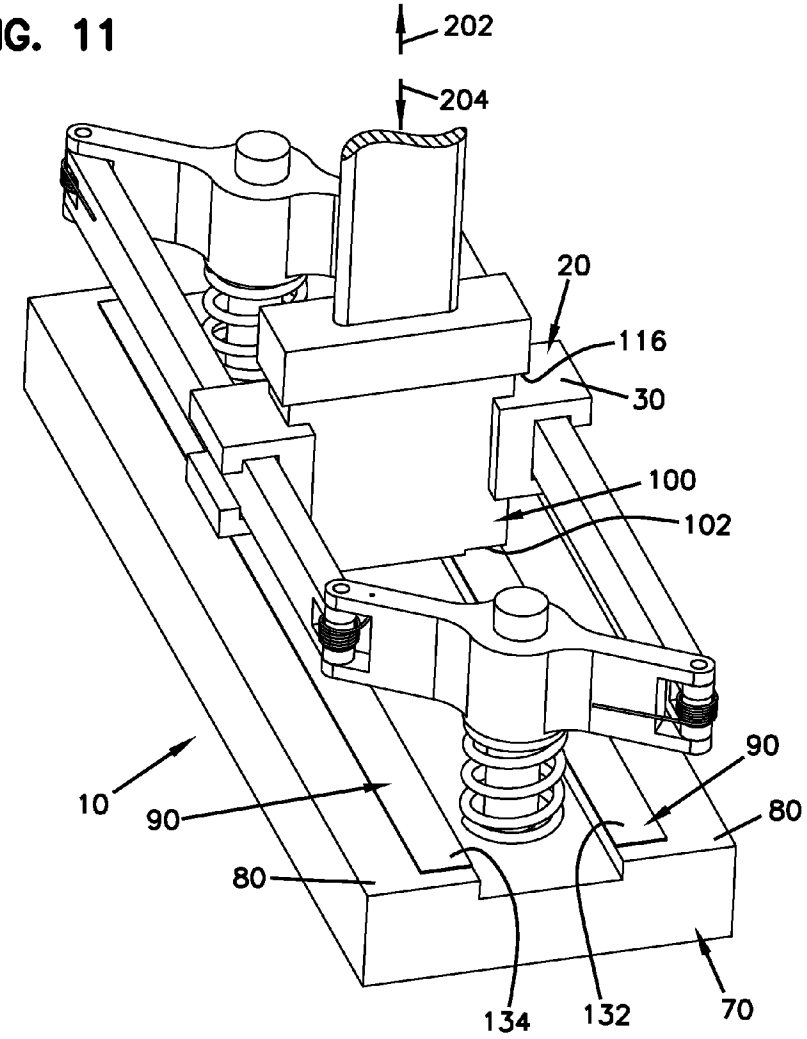
FIG. 11 is the perspective view of FIG. 10 but with the fiber optic ferrule slid within the ferrule holder.
Figure 10:
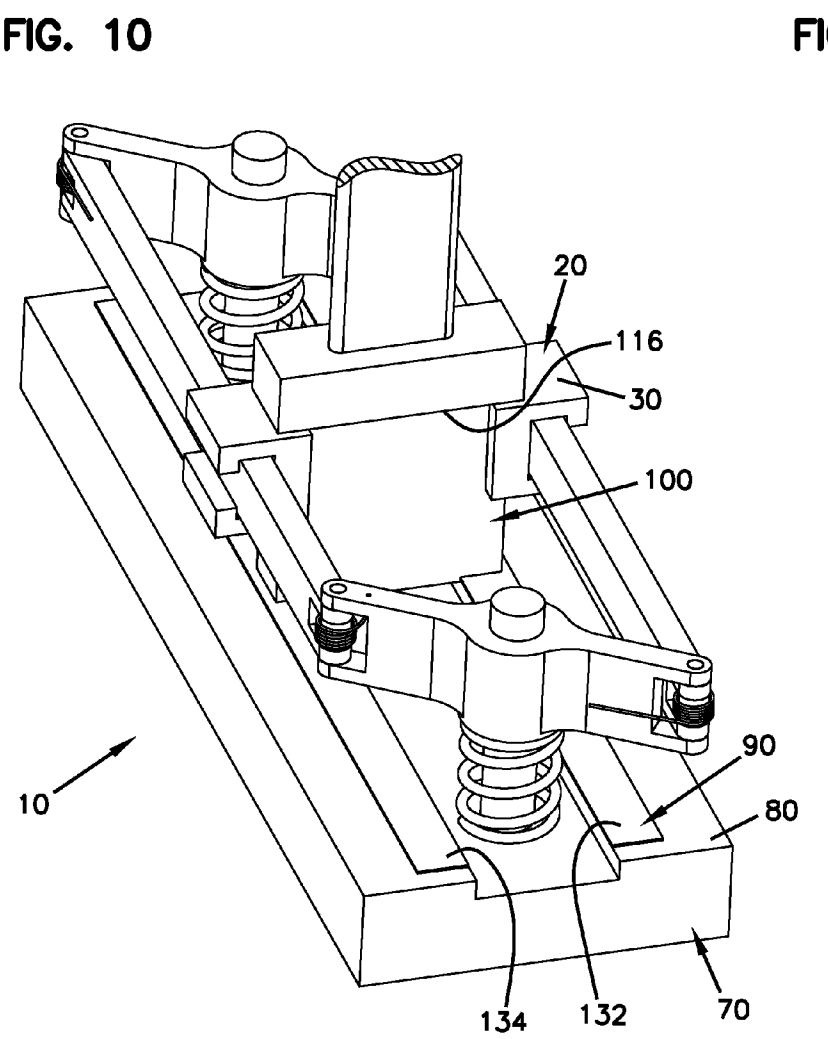
FIG. 10 is another perspective view of the tool and the fiber optic ferrule of FIG. 1.

In an alternate embodiment, illustrated at FIGS. 10 and 11, the fiber optic ferrule holder 20 is spaced from the material removing regions 132, 134 by a fixed distance D4 (see FIG. 7). In this embodiment, the fiber optic ferrule holder 20 is adapted to allow the fiber optic ferrule 100 to slide in the engaging and the disengaging directions 204, 202. Thus, by sliding the fiber optic ferrule 100 in the engaging direction 204, the endface 102 can be engaged with the material removing regions 132, 134 of the base 70, and by sliding the fiber optic ferrule 100 in the disengaging direction 202, the endface 102 can be disengaged from the material removing regions 132, 134. The endface 102 and the material removing regions 132, 134 are illustrated as engaged at FIG. 10, and the endface 102 and the material removing regions 132, 134 are illustrated as disengaged at FIG. 11.

In certain embodiments, the guide arrangement 14 includes a parallelogram linkage 40 that centers a pair of jaws 22, 24 of the fiber optic ferrule holder 20 and thereby centers the pair of the pin holes 122, 124 with respect to the pair of the adjacent edges 96, 98 of the material removing regions 132, 134. In certain embodiments, the base 70 includes a recessed area 76 adjoining and extending parallel to the pair of the adjacent edges 96, 98 (see FIGS. 6 and 7). In certain embodiments, the material removing regions 132, 134 of the base 70 include material removing media 90 (e.g., polishing paper, a polishing compound, sandpaper, etc.). In certain embodiments, the pair of the jaws 22, 24, the pair of the pin holes 122, 124, the pair of the adjacent edges 96, 98, the recessed area 76, the base 70, the material removing media 90, the sides 109, 110 of the fiber optic ferrule 100, and/or the material removing regions 132, 134 are centered relative to plane P1, mentioned above, that is parallel to the pair of the adjacent edges 96, 98 and perpendicular to the material removing regions 132, 134 of the base 70. In these embodiments, the plane P1 is a center plane.

In a preferred embodiment, the tool 10 includes the fiber optic ferrule holder 20, the parallelogram linkage 40, and the base 70. The fiber optic ferrule holder 20 includes the pair of the jaws 22, 24 adapted to clamp the fiber optic ferrule 100. The parallelogram linkage 40 includes a pair of pivoting links 42, 44 and a pair of guiding links 52, 54. The pivoting link 42 is positioned opposite from the pivoting link 44, and the guiding link 52 is positioned opposite from the guiding link 54 about the parallelogram linkage. The pivoting link 42 and the guiding link 52 are connected at a joint 322. The pivoting link 42 and the guiding link 54 are connected at a joint 324. The pivoting link 44 and the guiding link 52 are connected at a joint 342. The pivoting link 44 and the guiding link 54 are connected at a joint 344 (see FIG. 8). As illustrated, the joints 322, 324, 342, 344 are cylindrical joints that employ pins 320 as the joining element (see FIG. 5). In other embodiments, one or more of the joints 322, 324, 342, 344 can be a spherical joint employing a spherical element (e.g., a rod eye).

Figure 8:
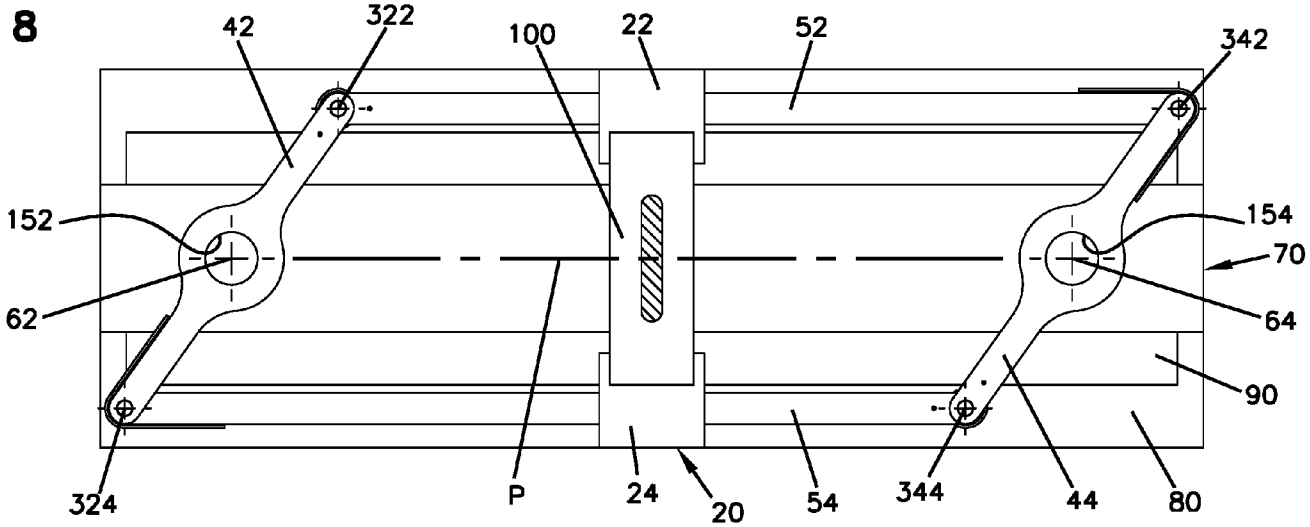
FIG. 8 is a top plan view of the tool and the fiber optic ferrule of FIG. 1.
Figure 9:
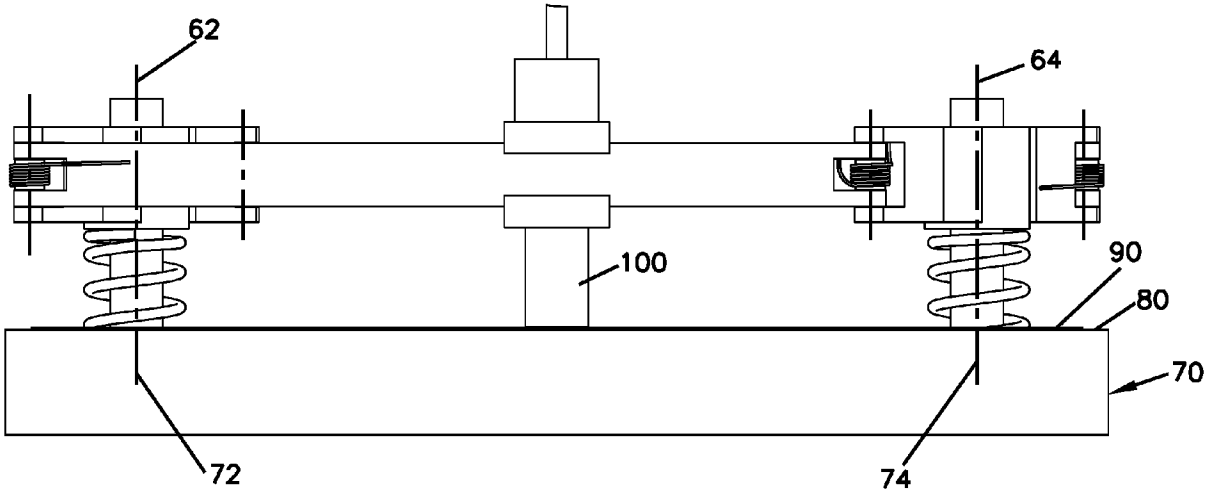
FIG. 9 is a side elevation view of the tool and the fiber optic ferrule of FIG. 1.

The pivoting link 42 defines a link pivot axis 62, and the pivoting link 44 defines a link pivot axis 64 (see FIG. 8). The guiding link 52 is positioned on an opposite side of the fiber optic ferrule holder 20 from the guiding link 54. The pair of the guiding links 52, 54 linearly guides the fiber optic ferrule holder 20 along a guided path P (see FIG. 8). The guided path P can be contained within the center plane P1 or can be parallel with the center plane P1. The jaw 22 of the fiber optic ferrule holder 20 slidingly attaches to the guiding link 52, and the jaw 24 slidingly attaches to the guiding link 54. The base 70 defines a pair of base pivot axes 72, 74 and includes a media bed 80 (see FIGS. 8 and 9). The pivoting link 42 rotatably connects about the link pivot axis 62 to the base 70 about the base pivot axis 72, and the pivoting link 44 rotatably connects about the link pivot axis 64 to the base 70 about the base pivot axis 74. The axes 62, 64, 72, 74 can be contained within the center plane P1. The link pivot axis 62 can be centered between the linkage joints 322 and 324, and the link pivot axis 64 can be centered between the linkage joints 342 and 344.

In certain embodiments, the material removing media 90 is mounted to the media bed 80 of the base 70. Adhesives, clamps, vacuum, and other methods can be used to mount the material removing media 90 to the base 70. The material removing media 90 extends parallel to the guided path P and is adapted to remove the material from the endface 102 of the fiber optic ferrule 100. The material is removed when the fiber optic ferrule 100 is clamped between the pair of the jaws 22, 24 of the fiber optic ferrule holder 20, the endface 102 of the fiber optic ferrule 100 is engaged with the material removing media 90, and the fiber optic ferrule holder 20 is moved along the guided path P. In certain embodiments, the media bed 80 of the base 70 includes the recessed area 76 that extends parallel to the guided path P, and the material removing media 90 includes a pair of media sheets 92, 94 (e.g., sandpaper or polishing paper). The media sheet 92 includes the edge 96 that is parallel to the guided path P, and the media sheet 94 includes the edge 98 that is also parallel to the guided path P. The media sheets 92, 94 are positioned opposite the recessed area 76 of the media bed 80 from each other, and the edge 96, 98 of each of the media sheets 92, 94 is positioned adjacent the recessed area 76. As mentioned above, the recessed area 76 can be a centered recess area that is centered about the fiber optic ferrule 100 when the fiber optic ferrule 100 is mounted in the fiber optic ferrule holder 20. The centered recessed area 76 of the media bed 80 can be configured and the media sheets 92, 94 can thereby be positioned such that the material removed from the endface 102 of the fiber optic ferrule 100 forms the pair of the recesses 112, 114 adjacent the corresponding pin holes 122, 124 of the fiber optic ferrule 100. The fiber terminating region 108 of the endface 102 of the fiber optic ferrule 100 can occupy the recessed area 76 and thereby avoid engagement with the material removing media 90. The pair of the base pivot axes 72, 74 can be centered between the edges 96, 98 of the pair of the media sheets 92, 94.

In certain embodiments, the fiber optic ferrule holder 20 is moved along the guided path P manually (e.g., by hand). In certain embodiments, the base 70 includes a pair of pivot posts 82, 84 that correspondingly define the pair of the base pivot axes 72, 74. In certain embodiments, the pivoting link 42 includes a bore 152 that defines the link pivot axis 62, and the pivoting link 44 includes a bore 154 that defines the link pivot axis 64 (see FIGS. 5 and 8). The pivot post 82 rotatably mounts the bore 152 and thereby aligns the link pivot axis 62 and base pivot axis 72, and the pivot post 84 rotatably mounts the bore 154 and thereby aligns the link pivot axis 64 and base pivot axis 74. The pivot post 82 can rotatably and translatably mount the bore 152, and the pivot post 84 can rotatably and translatably mount the bore 154. The link pivot axis 62 and the base pivot axis 72, and the link pivot axis 64 and the base pivot axis 74 are thereby aligned. The fiber optic ferrule holder 20 can thereby be spaced from the media bed 80 at the variable distance D3 (see FIGS. 6 and 7) with the fiber optic ferrule holder 20 adapted to fixedly hold the fiber optic ferrule 100. The fiber optic ferrule 100 can thereby engage the material removing media 90 mounted to the media bed 80 of the base 70 by the bores 152, 154 of the pivoting links 42, 44 sliding along the pivot posts 82, 84 of the base 70. Alternatively, the pivot posts 82, 84 can only rotatably mount the corresponding one of the bores 152, 154. The fiber optic ferrule holder 20 can thereby be spaced from the media bed at the fixed distance D4 (see FIG. 7). As mentioned above, the fiber optic ferrule holder 20 can be adapted to slidingly hold the fiber optic ferrule 100 (see FIGS. 10 and 11). The fiber optic ferrule holder 20 can thereby allow the fiber optic ferrule 100 to engage the material removing media 90 mounted to the media bed 80 of the base 70.

Figure 12:
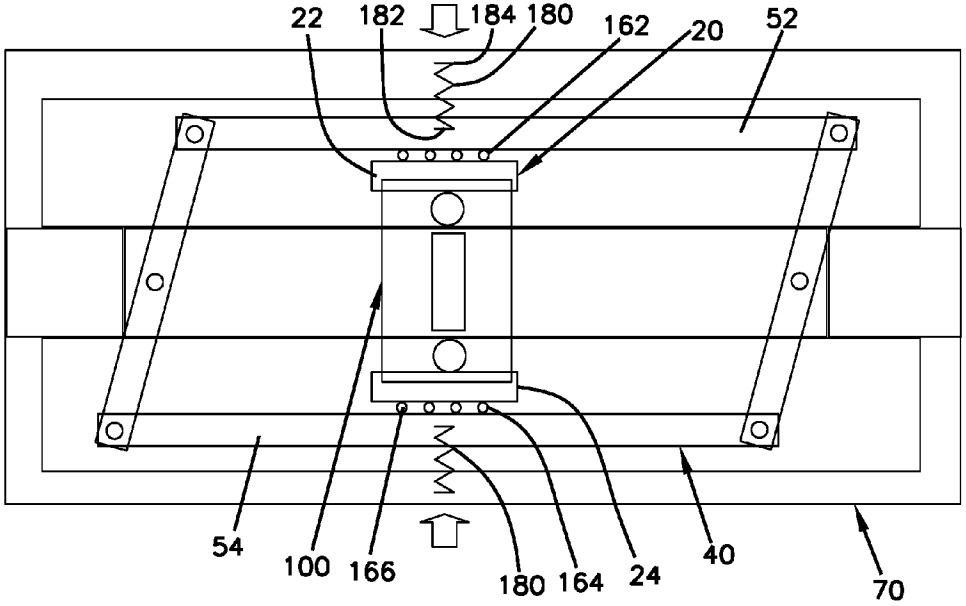
FIG. 12 is a top plan schematic view of a tool and a fiber optic ferrule mounted in the tool.
Figure 13:
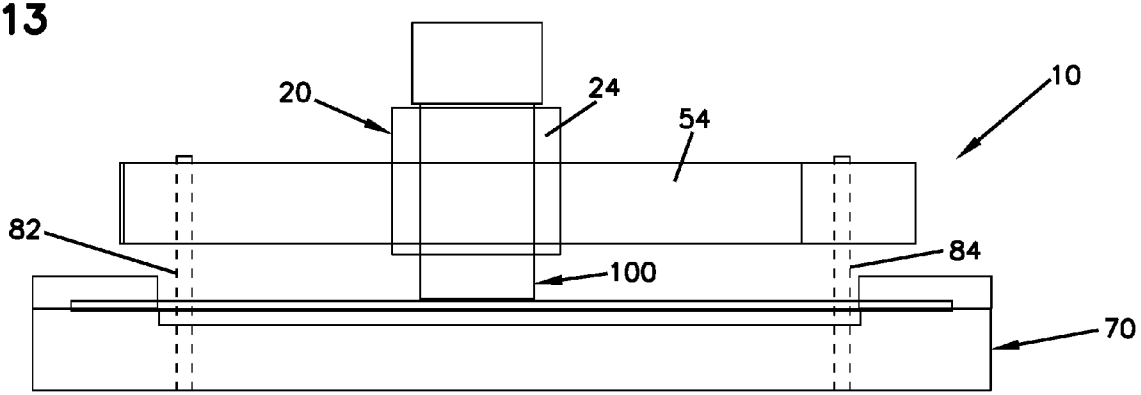
FIG. 13 is a side elevation schematic view of the tool and the fiber optic ferrule of FIG. 12.
Figure 14:
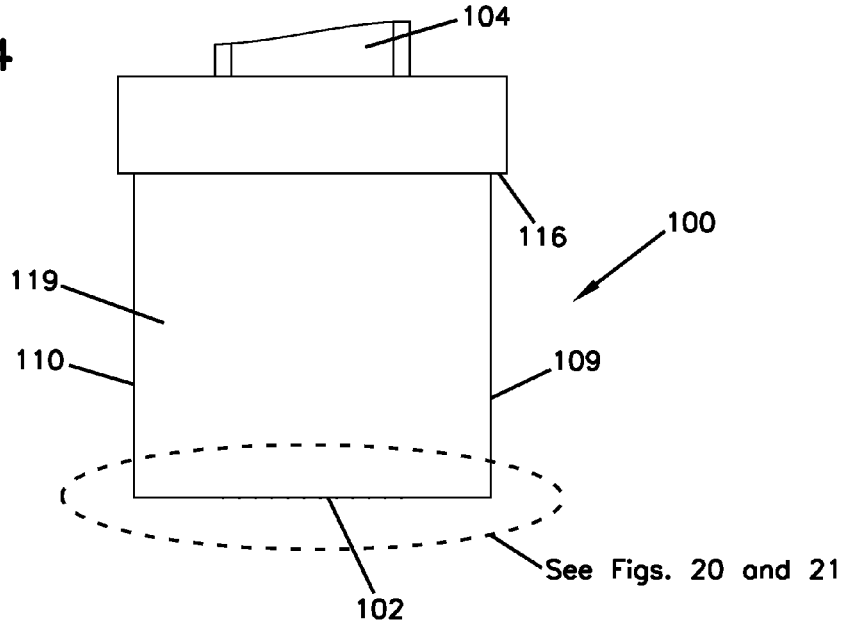
FIG. 14 is a side elevation view of the fiber optic ferrule of FIG. 1.

In certain embodiments, the tool 10 further includes a pair of linear bearings 162, 164 (see FIG. 12). The linear bearing 162 slidingly attaches the jaw 22 of the fiber optic ferrule holder 20 to the guiding link 52, and the linear bearing 164 slidingly attaches the jaw 24 to the guiding link 54. Each of the linear bearings 162, 164 can include rolling elements 166 (e.g., recirculating balls or wheels).

In certain embodiments, the parallelogram linkage 40 is spring loaded such that the guiding links 52, 54 are urged together and thereby urge the jaws 22, 24 of the fiber optic ferrule holder 20 together. The tool 10 can include at least one spring 180 operably connected between the base 70 and at least one of the guiding links 52, 54. As illustrated at FIG. 12, a first spring 180 is connected to the guiding link 52 at a first end 182 and is connected to the base 70 at a second end 184. Likewise, a second spring 180 is connected between the guiding link 54 and the base 70. The tool 10 can include at least one torsion spring 240, 250 operably connected across at least one of the linkage joints 322, 324, 342, 344 (see FIG. 5). The tool 10 can include at least one spring 170 operably connected between at least one of the pivoting links 42, 44 and the base 70. The spring 170 can be a torsion spring 170, a linear spring 170 (e.g., a compression coil spring and/or a tension coil spring), or a combined spring 170 (i.e., a combination spring providing both torsional and linear spring functions).

Figure 4:
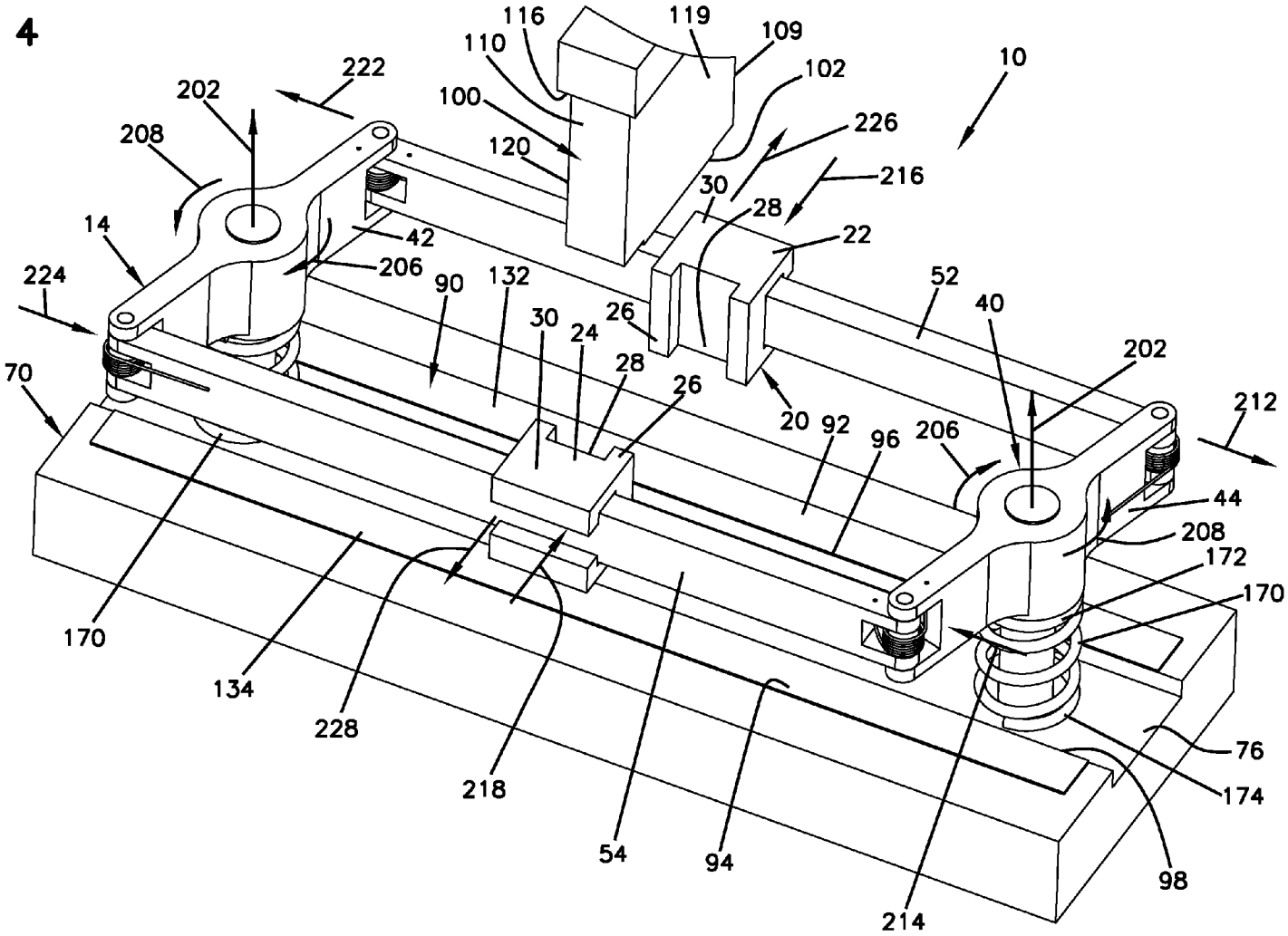
FIG. 4 is a partial perspective view sharing the perspective of FIG. 1 illustrating the tool of FIG. 1 with the fiber optic ferrule of FIG. 1 dismounted from the ferrule holder.
Figure 5:
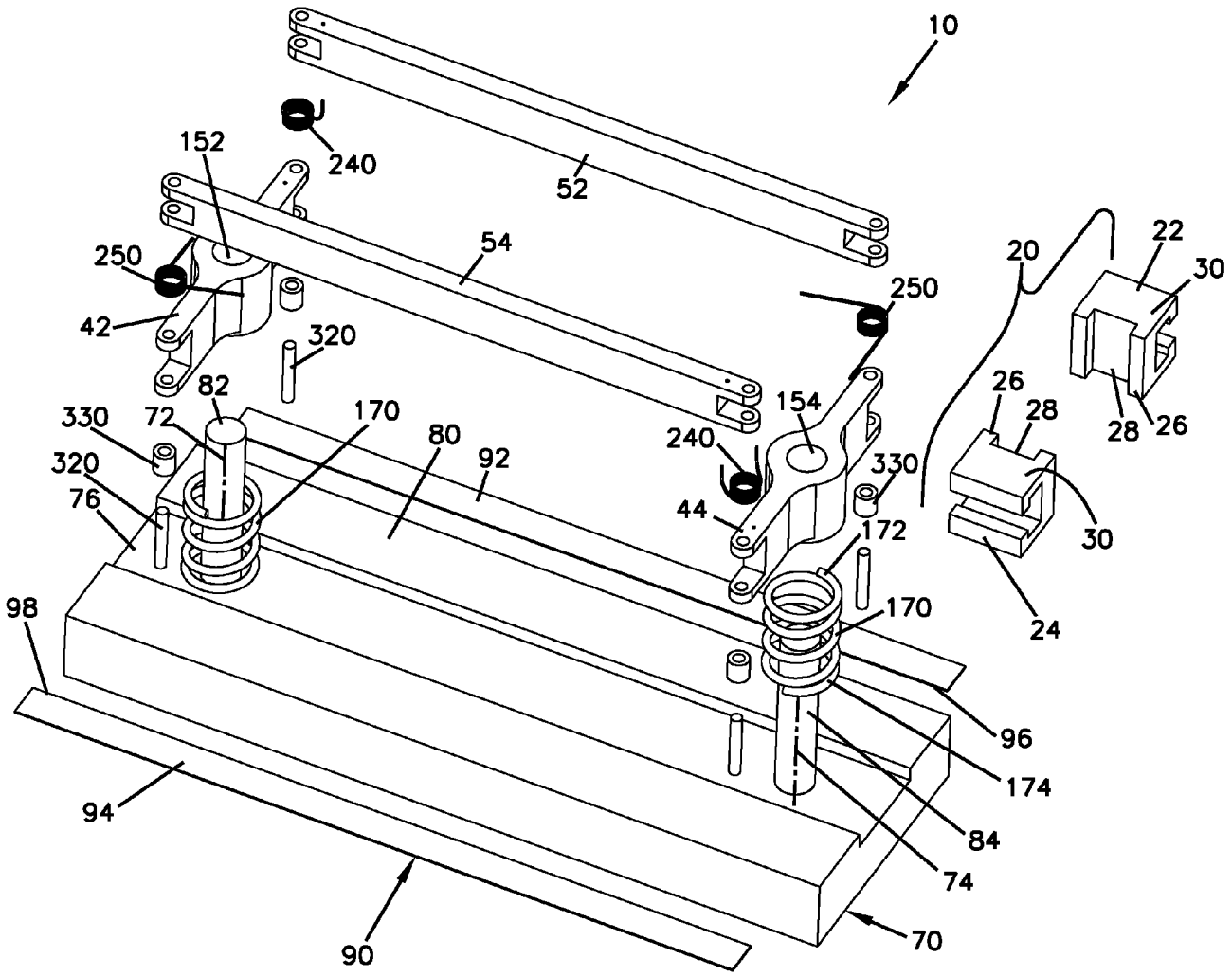
FIG. 5 is an exploded perspective view sharing the perspective of FIG. 1 illustrating the tool of FIG. 1.

The combined spring 170 can provide several functions. A first function is linearly spring-loading the guide arrangement 14. As illustrated at FIGS. 4 and 5, a first combined spring 170 is connected to the pivoting link 44 at a first end 172 and connected to the base 70 at a second end 174. Likewise, a second combined spring 170 is connected between the base 70 and the pivoting link 42. The first combined spring 170 spring-loads the translatably mounted pivoting link 44 along the link pivot-base pivot axis 64, 74, and the second combined spring 170 spring-loads the translatably mounted pivoting link 42 along the link pivot-base pivot axis 62, 72. The parallelogram linkage 40 is thereby spring-loaded and urged in the direction 202 as illustrated at FIG. 4. An engagement force in the direction 204 can be applied to the ferrule 100, the ferrule holder 20, and/or the parallelogram linkage 40 to engage the endface 102 of the ferrule 100 with the material removing media 90 as illustrated at FIGS. 2 and 7. The direction 204 and the direction 202 are opposite, and the engagement force overcomes the urging of the spring 170 in the direction 202.

The combined spring 170 also provides a second function that rotationally spring-loads the guide arrangement 14. The first combined spring 170 spring-loads the rotatably mounted pivoting link 44 about the link pivot-base pivot axis 64, 74, and the second combined spring 170 spring-loads the rotatably mounted pivoting link 42 about the link pivot-base pivot axis 62, 72. The parallelogram linkage 40 is thereby spring-loaded and urged in a clamping motion as illustrated at FIG. 4. In particular, the springs 170 urge the pivoting links 42, 44 in a rotational direction 206. The rotational direction 206 is a clockwise direction as illustrated at FIG. 4. The rotational urging of the pivoting links 42, 44 urges the guiding link 52 in a direction 212 and urges the guiding link 54 in a direction 214. The rotational urging of the pivoting links 42, 44 also urges the guiding link 52 in a direction 216 and urges the guiding link 54 in a direction 218. The urging of the guiding link 52 in the direction 216 is transferred to urge the jaw 22 in the direction 216, and the urging of the guiding link 54 in the direction 218 is transferred to urge the jaw 24 in the direction 218. The clamping motion thus results from the above urgings in the directions 206, 212, 214, 216, and 218.

The clamping motion of the preceding paragraph can be reversed by urging the pivoting links 42, 44 in a rotational direction 208 (the rotational direction 208 is a counter-clockwise direction as illustrated at FIG. 4), urging the guiding link 52 in a direction 222, urging the guiding link 54 in a direction 224, urging the guiding link 52 in a direction 226, urging the guiding link 54 in a direction 228, urging the jaw 22 in the direction 226, and/or urging the jaw 24 in the direction 228. An unclamping motion thus results if a combination of the above urgings in the directions 208, 222, 224, 226, and 228 overcome the first and/or the second combined springs 170.

The above clamping motion can also be achieved by one or more of the torsion springs 240, 250 connected across one or more of the linkage joints 322, 324, 342, 344 (see FIGS. 2, 5, and 8). As illustrated, one of the torsion springs 240 is positioned across the linkage joint 322 between the pivoting link 42 and the guiding link 52, one of the torsion springs 240 is positioned across the linkage joint 344 between the pivoting link 44 and the guiding link 54, one of the torsion springs 250 is positioned across the linkage joint 324 between the pivoting link 42 and the guiding link 54, and one of the torsion springs 250 is positioned across the linkage joint 342 between the pivoting link 44 and the guiding link 52. A spring mandrel 330 can be positioned between each of the torsion springs 240, 250 and the corresponding pin 320.

The above unclamping motion can also be applied to the tool 10 that includes the torsion springs 240, 250. In particular, the unclamping motion results if the combination of the above urgings in the directions 208, 222, 224, 226, and 228 overcome the torsion springs 240, 250.

The torsion springs 240, 250 can be employed in combination with the combined springs 170 and thereby provide the parallelogram linkage 40 with two clamping means. In certain embodiments, the torsion springs 240, 250 can be employed in combination with the linear springs 170. In these embodiments, the torsion springs 240, 250 provide the parallelogram linkage 40 with the clamping means, and the linear springs 170 urge the parallelogram linkage 40 in the direction 202.

One or more stops can be placed between the pivot post 82 and the pivoting link 42 and/or between the pivot post 84 and the pivoting link 44 to limit the range of motion between the pivot posts 82, 84 and the pivoting links 42, 44. The stop can limit relative linear motion and/or relative rotational movement. The stop can be single sided and thus limit movement beyond a predetermined position or the stop can be dual sided and thus limit movement between two predetermined positions.

One or more stops can be placed across one or more of the linkage joints 322, 324, 342, 344 to limit the range of motion of the parallelogram linkage 40. In particular, the stops can limit relative rotational movement between the pivoting link 42 and the guiding link 52, between the pivoting link 44 and the guiding link 54, between the pivoting link 42 and the guiding link 54, and/or between the pivoting link 44 and the guiding link 52. The stops can be single sided and thus limit movement of the parallelogram linkage 40 beyond a predetermined position or the stops can be dual sided and thus limit movement of the parallelogram linkage 40 between two predetermined positions.

In certain embodiments, at least one retaining lip 26 (see FIG. 5) is included on at least one of the jaws 22, 24 of the fiber optic ferrule holder 20. The retaining lip 26 can be adapted to orient the fiber optic ferrule 100. As illustrated, each of the jaws 22, 24 includes a pair of the retaining lips 26 positioned opposite a clamping surface 28 (see FIG. 5) from each other. The pair of the retaining lips 26 can trap and thereby locate the fiber optic ferrule 100 with respect to the jaw 22, 24. As illustrated, one of the retaining lips 26 engages a third side 119 of the fiber optic ferrule 100, and another of the retaining lips 26 engages a fourth side 120 of the fiber optic ferrule 100 (see FIGS. 4, 5, and 14-19). As illustrated, the clamping surface 28 of the jaw 22 abuts the first side 109 of the fiber optic ferrule 100, and the clamping surface 28 of the jaw 24 abuts the second side 110 when the fiber optic ferrule 100 is held by the fiber optic ferrule holder 20. A flange 116 of the fiber optic ferrule 100 can abut a surface 30 of the jaws 22, 24 and thereby locate the fiber optic ferrule 100 with respect to the jaws 22, 24.

In the depicted embodiment, the endface 102 of the fiber optic ferrule 100 is substantially perpendicular to the sides 109, 110, 119, 120. In other embodiments, the endface 102 of the fiber optic ferrule 100 can be non-perpendicular to one or more of the sides 109, 110, 119, 120. In the depicted embodiment, the recesses 112, 114 are substantially parallel to the endface 102. In other embodiments, the recesses 112, 114 can be non-parallel to the endface 102.

The present disclosure also relates to a method of forming one or more of the recesses 112, 114 on the endface 102 of the fiber optic ferrule 100. The recess 112 is adjacent the pin hole 122, and the recess 114 is adjacent the pin hole 124. The method includes providing the fiber optic ferrule 100; providing the tool 10; mounting the fiber optic ferrule 100 to the fiber optic ferrule holder 20; engaging the endface 102 of the fiber optic ferrule 100 with the material removing members 132, 134 of the tool 10; moving the fiber optic ferrule holder 20 along the guided path P; and dismounting the fiber optic ferrule 100 from the fiber optic ferrule holder 20. The tool 10 can include the base 70, the fiber optic ferrule holder 20 that is slidingly mounted to the base 70 along the guided path P, and a pair of the material removing members 132, 134 that extend in a direction parallel to the guided path P. The material removing members 132, 134 can be spaced a distance D1, perpendicular to the guided path, from each other and mounted to the base 70. The mounting of the fiber optic ferrule 100 to the fiber optic ferrule holder 20 can include clamping the fiber optic ferrule 100 between the pair of the jaws 22, 24 of the fiber optic ferrule holder 20. The tool 10 can define the plane P1 parallel to the guided path P and perpendicular to material removing surfaces of the material removing members 132, 134. The distance D1 that the pair of the material removing members 132, 134 are spaced from each other can be centered about the center plane P1, and the tool 10 can further include the linkage 40 adapted to center the pair of the jaws 22, 24 about the center plane P1. The linkage 40 can include the pair of the guiding links 52, 54, the pair of the pivoting links 42, 44, can be the parallelogram linkage 40, and/or can be rotatably mounted to the base 70 about the axes 72, 74. The pair of the axes 72, 74 can be contained within the center plane P1.

From the forgoing detailed description, it will be evident that modifications and variations can be made in the devices and methods of the disclosure without departing from the spirit or scope of the invention.

What is claimed is:

1. A tool for removing material from an endface of a fiber optic ferrule, the tool comprising:

a fiber optic ferrule holder including a pair of jaws adapted to clamp the fiber optic ferrule;

a parallelogram linkage including a pair of pivoting links and a pair of guiding links, the pair of the pivoting links positioned opposite from each other and the pair of the guiding links positioned opposite from each other about the parallelogram linkage, each of the pivoting links defining a link pivot axis, each of the guiding links positioned on opposite sides of the fiber optic ferrule holder, the pair of the guiding links linearly guiding the fiber optic ferrule holder along a guided path, and each of the jaws of the fiber optic ferrule holder slidingly attached to a corresponding one of the pair of the guiding links;

a base defining a pair of base pivot axes and including a media bed; each of the pivoting links rotatably connected about the link pivot axis to the base about a corresponding one of the pair of the base pivot axes.

2. The tool of claim 1, further comprising material removing media mounted to the media bed of the base, the material removing media extending parallel to the guided path and adapted to remove the material from the endface of the fiber optic ferrule when the fiber optic ferrule is clamped between the pair of the jaws of the fiber optic ferrule holder, the endface of the fiber optic ferrule is engaged with the material removing media, and the fiber optic ferrule holder is moved along the guided path.

3. The tool of claim 2, wherein the media bed of the base includes a recessed area extending parallel to the guided path and wherein the material removing media includes a pair of media sheets that each include an edge parallel to the guided path, the media sheets are positioned opposite the recessed area of the media bed from each other, and the edge of each of the media sheets is positioned adjacent the recessed area.

4. The tool of claim 3, wherein the recessed area is a centered recess area, the pair of the base pivot axes is centered between the edges of the pair of the media sheets, and each of the link pivot axes is centered between a pair of corresponding linkage joints between the pivoting links and the guiding links.

5. The tool of claim 3, wherein the media sheets include polishing paper.

6. The tool of claim 4, wherein the centered recessed area of the media bed is configured and the media sheets are thereby positioned such that the material removed from the endface of the fiber optic ferrule forms a pair of recesses adjacent a corresponding pair of pin holes of the fiber optic ferrule.

7. The tool of claim 2, wherein the material removed from the endface of the fiber optic ferrule results in polishing of the endface.

8. The tool of claim 2, wherein the fiber optic ferrule holder is moved along the guided path manually.

9. The tool of claim 1, wherein the base includes a pair of pivot posts that correspondingly define the pair of the base pivot axes and the pivoting links each include a bore that defines the corresponding link pivot axis and wherein each of the pivot posts rotatably mounts a corresponding one of the bores and thereby align the corresponding link pivot and base pivot axes.

10. The tool of claim 9, wherein each of the pivot posts rotatably and translatably mount the corresponding one of the bores and thereby align the corresponding link pivot and base pivot axes.

11. The tool of claim 1, further comprising a pair of linear bearings, each of the linear bearings slidingly attaching a corresponding one of the pair of the jaws of the fiber optic ferrule holder to the corresponding guiding link.

12. The tool of claim 11, wherein each of the linear bearings includes rolling elements.

13. The tool of claim 1, wherein the parallelogram linkage is spring loaded such that the guiding links are urged together and thereby urge the jaws of the fiber optic ferrule holder together.

14. The tool of claim 13, further comprising at least one spring operably connected between the base and at least one of the guiding links.

15. The tool of claim 13, further comprising at least one torsion spring operably connected across at least one linkage joint between the pivoting links and the guiding links.

16. The tool of claim 13, further comprising at least one torsion spring operably connected between at least one of the pivoting links and the base.

17. The tool of claim 1, wherein at least one retaining lip of at least one of the jaws of the fiber optic ferrule holder is adapted to orient the fiber optic ferrule.

18. The tool of claim 17, wherein the at least one of the jaws includes a pair of the retaining lips.

19. The tool of claim 9, wherein the fiber optic ferrule holder is spaced from the media bed at a fixed distance and the fiber optic ferrule holder is adapted to slidingly hold the fiber optic ferrule and thereby allow the fiber optic ferrule to engage material removing media mounted to the media bed of the base.

20. The tool of claim 10, wherein the fiber optic ferrule holder is spaced from the media bed at a variable distance, the fiber optic ferrule holder is adapted to fixedly hold the fiber optic ferrule, and the fiber optic ferrule engages material removing media mounted to the media bed of the base by the bores of the pivoting links sliding along the pivot posts of the base.

21. A method for forming a pair of recesses on an endface of a fiber optic ferrule, each of the recesses adjacent one pin hole of a pair of pin holes of the fiber optic ferrule, the method comprising:

providing the fiber optic ferrule;

providing a tool including a base, a fiber optic ferrule holder slidingly mounted to the base along a guided path, and a pair of material removing members extending in a direction parallel to the guided path, spaced a distance perpendicular to the guided path from each other, and mounted to the base;

mounting the fiber optic ferrule to the fiber optic ferrule holder;

engaging the endface of the fiber optic ferrule with the pair of the material removing members of the tool;

moving the fiber optic ferrule holder along the guided path;

forming the pair of the recesses on the endface of the fiber optic ferrule, each of the recesses adjacent one of the pin holes of the pair of pin holes of the fiber optic ferrule; and dismounting the fiber optic ferrule from the fiber optic ferrule holder.

22. The method of claim 21, wherein the fiber optic ferrule holder includes a pair of jaws adapted to clamp the fiber optic ferrule and wherein mounting the fiber optic ferrule to the fiber optic ferrule holder includes clamping the fiber optic ferrule between the pair of the jaws of the fiber optic ferrule holder.

23. The method of claim 22, wherein the tool defines a plane parallel to the guided path and perpendicular to material removing surfaces of the material removing members, wherein the distance that the pair of the material removing members are spaced from each other is centered about the plane, and wherein the tool further includes a linkage adapted to center the pair of the jaws about the plane.

24. The method of claim 23, wherein the linkage includes a pair of guiding links and wherein each of the jaws of the fiber optic ferrule holder is slidingly mounted to a corresponding one of the pair of the guiding links.

25. The method of claim 24, wherein the linkage is a parallelogram linkage and further includes a pair of pivoting links rotatably mounted to the base about a corresponding pair of axes and wherein the pair of the axes is contained within the plane.

26. A tool for forming a pair of recesses on an endface of a fiber optic ferrule, each of the recesses adjacent one pin hole of a pair of pin holes of the fiber optic ferrule, the tool comprising:

a base including a pair of opposed material removing regions, the pair of the material removing regions including a pair of adjacent edges, the pair of the material removing regions spaced from each other by a distance across a recessed area;

a fiber optic ferrule holder adapted to mount the fiber optic ferrule and thereby center the pair of the pin holes with respect to the pair of the adjacent edges of the material removing regions; and a guide arrangement adapted to guide the fiber optic ferrule holder along a plane parallel to the pair of the adjacent edges and perpendicular to the material removing regions;

wherein the guide arrangement includes a parallelogram linkage that centers a pair of jaws of the fiber optic ferrule holder and thereby centers the pair of the pin holes with respect to the pair of the adjacent edges of the material removing regions.

27. The tool of claim 26, further comprising at least one spring that urges the pair of the jaws to clamp the fiber optic ferrule when the fiber optic ferrule is mounted to the fiber optic ferrule holder.

28. The tool of claim 26, wherein the parallelogram linkage includes a pair of guiding links and wherein each of the jaws of the fiber optic ferrule holder is slidingly mounted to a corresponding one of the pair of the guiding links.

29. The tool of claim 26, wherein the base includes the recessed area adjoining and extending parallel to the pair of the adjacent edges of the material removing regions.

30. The tool of claim 26, wherein the material removing regions of the base include polishing paper.

* * * * *